US006271812B1

(12) United States Patent
Osada et al.

(10) Patent No.: US 6,271,812 B1
(45) Date of Patent: Aug. 7, 2001

(54) ELECTROLUMINESCENT DISPLAY DEVICE

(75) Inventors: Masahiko Osada, Hekinan; Ken Nishioka, Toyoake; Hiroyuki Kishita, Kariya; Hideki Saito, Chiryu; Toshinori Ninoyu, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/149,076

(22) Filed: Sep. 8, 1998

(30) Foreign Application Priority Data

Sep. 25, 1997 (JP) ..... 9-260636
Mar. 10, 1998 (JP) ..... 10-058185

(51) Int. Cl.[7] ..... G09G 3/30

(52) U.S. Cl. ..... 345/76; 345/55; 345/77; 345/78; 345/208; 345/210; 345/211; 345/214; 345/204; 315/169.1; 315/169.2; 315/169.4

(58) Field of Search ..... 345/76, 55, 98, 345/212, 213, 206, 211, 214, 77, 208, 210, 204; 340/455, 461, 462; 315/169.1, 169.2, 169.4

(56) References Cited

U.S. PATENT DOCUMENTS 5,648,755 * 7/1997 Yagihashi ..... 340/439
5,805,124 * 9/1998 Kapoor et al. ..... 345/76
5,844,368 * 10/1999 Okuda et al. ..... 345/76
5,856,813 * 1/1999 Katayama et al. ..... 345/76
5,973,456 * 10/1999 Osada et al. ..... 345/76
5,999,150 * 12/1999 Nighan et al. ..... 345/79
6,051,932 * 4/2000 Sheu et al. ..... 315/169.3

FOREIGN PATENT DOCUMENTS 8-328501 12/1996 (JP) .

* cited by examiner

*Primary Examiner*—Richard Hjerpe
*Assistant Examiner*—Ali Zamani
(74) *Attorney, Agent, or Firm*—Pillsbury Winthrop LLP

(57) ABSTRACT

An Electroluminescent display device is designed not to display residual images due to electric charges stored in electroluminescent pixels or to make them invisible, when the device is turned on again. The stored charges are eliminated at the time a normal display on the panel is turned off at an end of an operation, by scanning pixels at least one time while giving a non-activating data voltage thereto. Alternatively, upon turning on the panel, pixels which were activated in a previous use are all lit at least one time, thereby making the residual images invisible. Thus, the residual images stored in a previous operation are not shown or made invisible when the electroluminescent display device is turned on next time.

16 Claims, 14 Drawing Sheets

ELECTROLUMINESCENT DISPLAY DEVICE

CROSS-REFERENCE TO RELATED APPLICATIONS

This application is based upon and claims benefit of priority of Japanese Patent Applications No. Hei-9-260636 filed on Sep. 25, 1997, and No. Hei-10-58185 filed on Mar. 10, 1998, contents of which are incorporated herein by reference.

BACKGROUND OF THE INVENTION

1. Field of the Invention

The present invention relates to an electroluminescent display device in which residual images stored as electric charges in pixels are eliminated or made invisible on the display panel.

2. Description of Related Art

An electroluminescent (EL) display panel is generally composed of a pair of electrodes, a pair of insulation layers and a luminescent layer interposed therebetween. The display panel is driven by a driver including electrode driving circuits and a power source circuit.

It is known that polarized electric charges still remain in pixels after the panel is turned off. The relation between imposed voltages and electric charges in a pixel (Q-V characteristic) is illustrated in FIG. 15. The voltage (V) imposed on a pixel is shown on the abscissa and the electric charge (Q) stored in the pixel on the ordinate. The Q-V relation in the pixel takes a position ① when no voltage is applied and no electric charge is stored. To drive the EL panel, a positive pulse voltage (Vth+Vm) is imposed on the pixel in a positive field and a negative pulse voltage −(Vth+Vm) in a negative field. The voltage Vth is a threshold voltage with which the pixel starts emitting light, and the voltage Vm is a modulation voltage representing an image datum. When the positive pulse voltage is imposed, the Q-V relation changes along a path ①-②-③-④. This means that when the voltage becomes zero at the position ④, there still remains a certain electric charge. When the negative pulse voltage is imposed at that point ④, the Q-V relation changes along a path ④-⑤-⑥-⑦-⑧. When the positive and negative voltages are imposed alternatively after that point, the Q-V relation changes along a periphery of a parallelogram ⑨-③-⑤-⑦. The EL pixel emits light on lines ⑨-②-③ and ⑤-⑥-⑦.

To turn off the EL panel (to terminate light emission from the pixel), the voltage Vth is imposed in the positive field and the voltage −Vth in the negative field. If the voltage −Vth is imposed when a pixel is at the position ④, it returns to the position ① through the positions ⑤ and ⑥. If the voltage Vth is imposed when a pixel is at the position ⑧, it returns to the position ① through the positions ⑨ and ②. Therefore, no polarized electric charge is left in the pixel in both cases.

However, in actual use of the EL panel, some electric charges are left in the pixels after the panel is turned off. Under this situation, when the EL panel is turned on again and a voltage to make it dark is applied, the EL panel still emits light due to the electric charges remaining in the pixels. For example, if the EL pixel is at the position ④ when the power is turned off, and the voltage −Vth which makes the pixel dark is imposed when the power is turned on again, then its position changes along a path ④-⑤-⑥-①. The EL pixel emits light in a course of its position change from the point ⑤ to the point ⑥. Similarly, if the EL pixel is at the position ⑧ when the power is turned off, and the voltage Vth which makes the pixel dark is imposed when the power is turned on again, then its position changes along a path ⑧-⑨-②-①. The El pixel emits light in a course of its position change from the point ⑨ to the point ②. Therefore, an undesirable picture image is displayed on the panel due to the remaining electric charge when the power is supplied again after the power is once turned off. Actually, the image due to the remaining charge is mixed with an image to be first displayed, and the mixed image is displayed. Though this image is displayed only for a short time right after the power is turned on, it is still undesirable and uncomfortable for a viewer.

SUMMARY OF THE INVENTION

The present invention has been made in view of the above-mentioned problem, and an object of the present invention is to provide an electroluminescent (EL) display device, in which an undesirable picture image (a residual image) appearing when the device is turned on again is eliminated. The residual image can be eliminated by discharging electric charges stored in pixels when the display panel is turned off, or the residual image can be made invisible by activating all pixels storing residual images when the display panel is turned on again next time.

The electroluminescent display panel includes an array of scanning electrodes and another array of data electrodes. Both arrays are arranged to form a matrix, and an electroluminescent layer is interposed between both arrays. Picture elements or pixels are formed at each intersection of the scanning electrodes and the data electrodes. The electroluminescent panel is driven by imposing voltages on the picture elements by applying scanning voltages on the scanning electrodes and the data voltages on the data electrodes. When the EL panel is turned off, polarized electric charges are left in the pixels which have been activated. Those electric charges display residual images on the panel when the panel is turned on again next time. The residual images are undesirable and uncomfortable for a viewer.

To eliminate electric charges stored in the pixels, a voltage, a level of which is at a vicinity of scanning voltage, is applied on the scanning electrodes while applying a voltage to make the pixels inactive on the data electrodes, after the normal display on the panel is terminated. In other words, at the end of the normal display the EL panel is scanned at least one time to eliminate electric charges stored in the pixels which have been activated. Since the charge eliminating operation is performed upon turning off the EL panel, the residual images are not displayed when the panel is turned on next time.

Alternatively, upon turning on the EL panel, the pixels storing electric charges therein may be activated to emit light therefrom at least one time. By this operation the residual images are made invisible to a viewer. In this operation, all or substantially all the pixels are lit at least one time. This initial display may be designed to include some ornamental moving images. Further, the residual images can be made substantially invisible by delaying the normal display till the drive voltage reaches a predetermined level.

The EL panel according to the present invention may be suitably used as an instrument panel for an automobile. In this case, the EL panel is powered by a battery mounted on the automobile. When a key switch of the automobile is turned off, the process to eliminate the residual images is carried out by supplying power to the panel through a wired OR circuit, for example. Alternatively, the EL panel is lit at least one time before the normal display begins to make the residual images invisible.

This invention may also be applied to a segment-display type device in the same manner as in the matrix-display type device.

Other objects and features of the present invention will become more readily apparent from a better understanding of the preferred embodiments described below with reference to the following drawings.

BRIEF DESCRIPTION OF THE DRAWINGS

FIGS. 18A–18D show an example of images shown on the display panel when power is turned on; and FIGS. 19A–19D show another example of images shown in the display panel when power is turned on.

Figure 1:
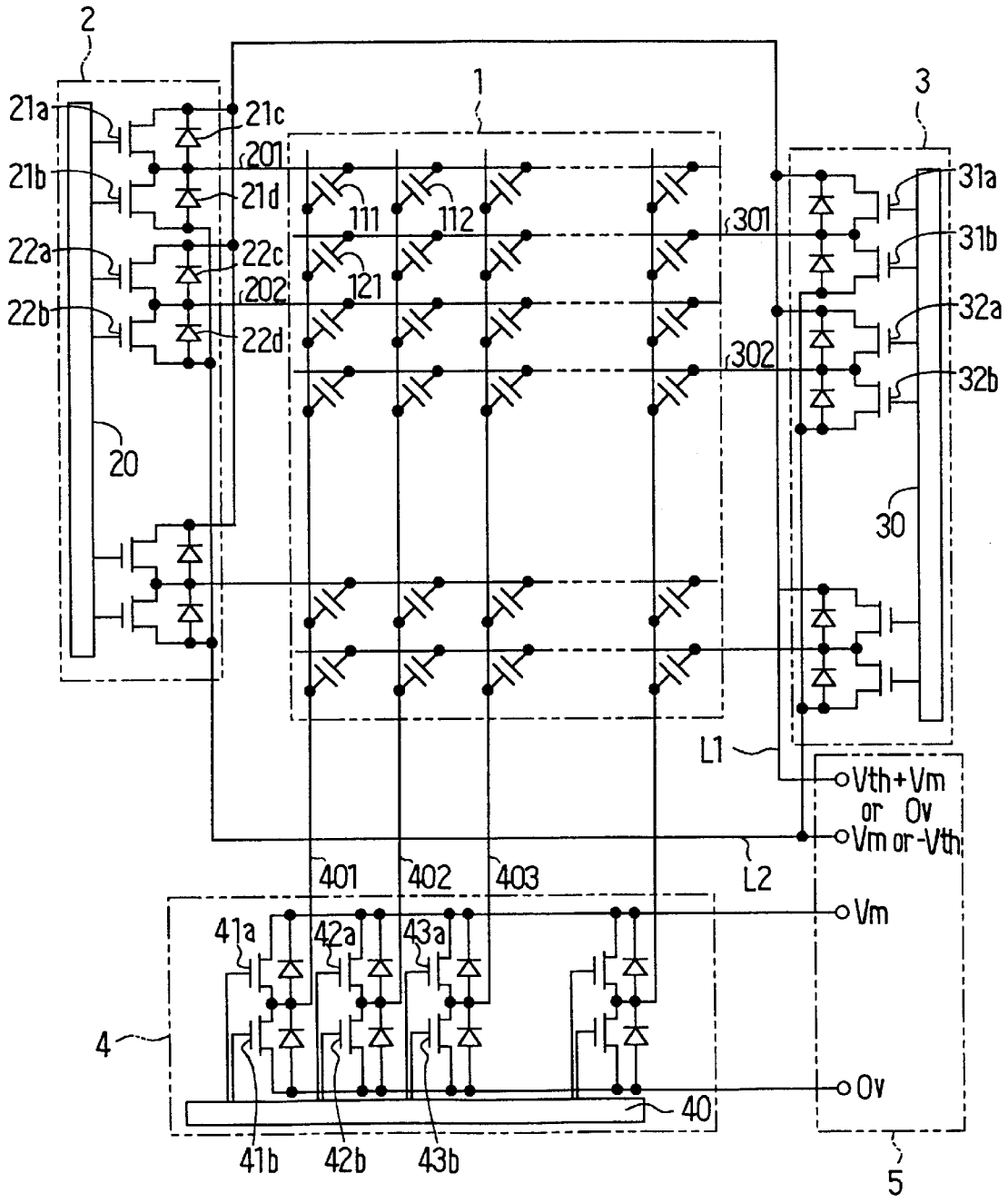
FIG. 1 is a circuit diagram showing a whole structure of an EL display device as a first embodiment of the present invention.

DETAILED DESCRIPTION OF THE PREFERRED EMBODIMENTS (First Embodiment)

Referring to FIGS. 1–13, a first embodiment of the present invention will be described. First, referring to FIG. 2, a general structure of an EL element 10 will be described. On a glass substrate 11, various layers are laminated in the following order: a transparent electrode 12, a first insulation layer 13, a luminescent layer 14, a second insulation layer 15 and a rear electrode 16. The luminescent layer 14 emits light by imposing a positive or negative pulse voltage between the transparent electrode 12 and the rear electrode 16. The light is emitted from the glass substrate 11, or from both surfaces if the rear electrode is made transparent.

Figure 2:
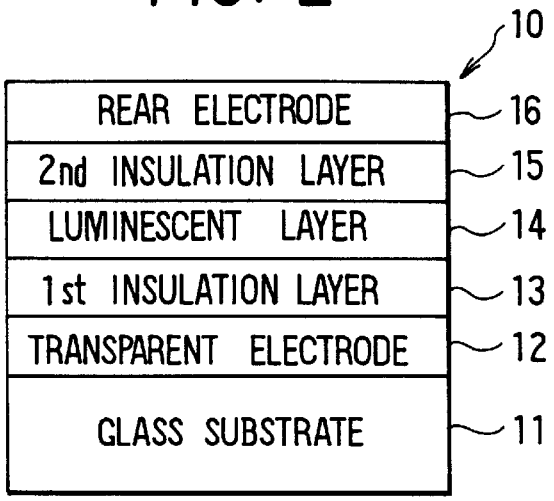
FIG. 2 is a schematic view showing an EL element.

FIG. 1 shows a whole structure of the EL display device according to the present invention. In an El display panel 1, the transparent electrode 12 shown in FIG. 2 corresponds to scanning electrodes 201, 202 . . . 301, 302 . . . , arranged in the row direction of the panel, and the rear electrodes 16 shown in FIG. 2 corresponds to data electrodes 401, 402, 403 . . . , arranged in the column direction of the panel. The scanning electrodes 201, 202 . . . are odd numbered row electrodes driven by a scanning electrode driving circuit 2, and the scanning electrodes 301, 302 . . . are even numbered row electrodes driven by another scanning electrode driving circuit 3. The data electrodes 401, 402, 403 . . . are driven by a data electrode driving circuit 4. At each intersection of both scanning and data electrodes, pixels 111, 112 . . . , 121 are formed. That is, all the pixels are arranged in a matrix on the panel. Because the pixels are capacitive elements, those pixels are shown as condensers in FIG. 1.

The scanning electrode driving circuit 2 which drives the odd numbered scanning electrodes is a push-pull type driver having P channel field-effect transistors (FETS) 21*a*, 22*a* . . . and N channel FETs 21*b*, 22*b* . . . , and applies scanning voltages to the odd numbered scanning electrodes according to outputs from a logic circuit 20. Parasitic diodes 21*c*, 21*d*, 22*c*, 22*d* . . . are formed in the respective FETs 21*a*, 21*b*, 22*a*, 22*b* . . . . and set the scanning voltage at a standard level. The scanning electrode driving circuit 3 which drives the even numbered scanning electrodes has the same structure as the scanning electrode driving circuit 2. The scanning electrode driving circuit 3 includes P channel FETs 31*a*, 32*a* . . . and N channel FETs 31*b*, 32*b* . . . , and applies scanning voltages to the even numbered scanning electrodes according to outputs form a logic circuit 30. Similarly, the data electrode driving circuit 4 has P channel FETs 41*a*, 42*a* . . . and N channel FETs 41*b*, 42*b* . . . , and supplies data voltages to the data electrodes 401, 402, 403 . . . according to outputs from a logic circuit 40. A power source circuit 5 supplies voltages to the scanning electrode driving circuits 2, 3 and the data electrode driving circuit 4.

The power source circuit 5 supplies, as scanning voltages, a voltage (Vth+Vm) or a zero volt (0 V, a ground voltage) to a common line L1 connected to source electrodes of the P channel FETs, and supplies a voltage Vm or −Vth to a common line L2 connected to source electrodes of the N channel FETs. Also, the power source circuit 5 supplies, as data voltages, the voltage Vm to a common line connected to source electrodes of P channel FETs and the ground voltage to another common line connected to source electrodes of N channel FETs. To drive the EL panel 1, positive voltages are imposed between the scanning electrodes and data electrodes in a positive field, and negative voltages in a negative field.

Figure 3:
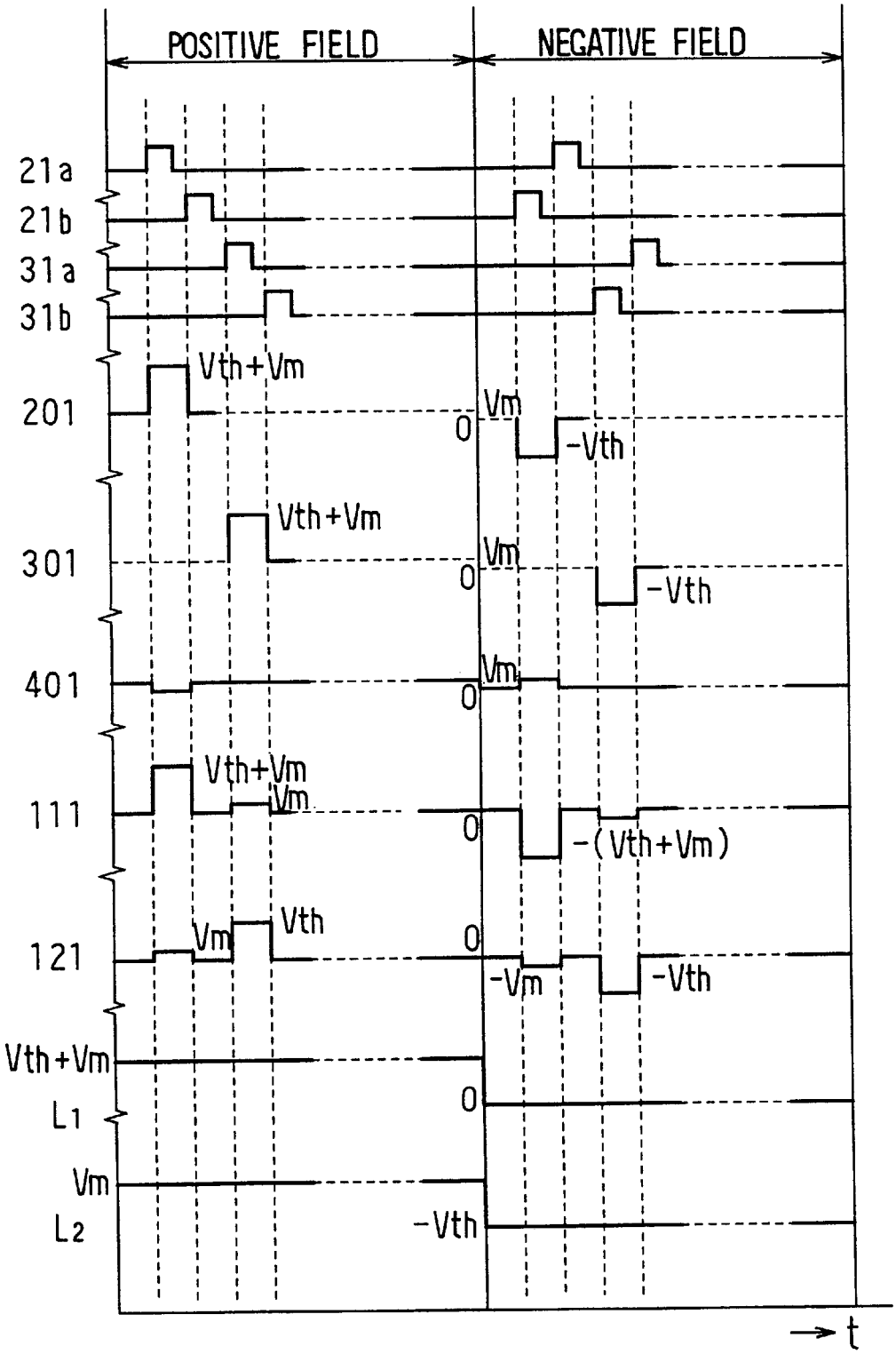
FIG. 3 is a time chart showing various voltages imposed on electrodes and pixels.

Referring to a time chart shown in FIG. 3, a driving process of the EL panel 1 will be described. A left half of the time chart shows the positive field and a right half the negative field. A high level in the time chart corresponds to an ON-state of FETs 21*a*, 21*b*, 31*a*, 31*b* . . . , and a low level corresponds to an OFF-state thereof. Waveforms are shown in the time chart, assuming there is no waveform deformation.

In the positive field, the voltage (Vth+Vm) is supplied to the common line L1 and the voltage Vm to the common line L2. At this time, a standard voltage of the scanning electrodes 201, 301, 202, 302 . . . is at a Vm level due to operation of parasitic diodes 21*d*, 22*d* . . . of the scanning electrode driving circuits 2, 3. The FETs 41*a*, 42*a*, 43*a* . . . of the data electrode driving circuit 4 are turned on, bringing the voltage of the data electrodes to Vm level. In this state no EL element (pixel) emits light because the voltage imposed on all of the EL elements is 0 volt. Following this state, light emitting operation of EL elements starts. First, the voltage (Vth+Vm) is applied to the scanning electrode 201 (the first row electrode) by turning on the P channel FET 21*a* connected to the scanning electrode 201. At the same time, FETs connected to all other scanning electrodes are turned off, thereby bringing those scanning electrodes to a floating state. P channel FETs of the data electrode driving circuit 4 connected to data electrodes corresponding to pixels to be lit are turned off, and N channel FETs connected to the same data electrodes are turned on. At the same time, P channel FETs of the data electrode driving circuit 4 connected to other data electrodes corresponding to pixels not to be lit are turned on, and N channel FETs connected to the same data electrodes are turned off.

Thus, pixels to be lit emit light because data electrodes connected to those pixels become the ground level and the voltage (Vth+Vm) is imposed on those pixels. Pixels not to be lit do not emit light because data electrodes connected thereto remains at the voltage Vm and the voltage Vth is imposed on those pixels. The time chart in FIG. 3 shows a situation, where the P channel FET 41*a* of the data electrode driving circuit 4 is turned off while the N channel FET 41*b* is turned on, and the voltage (Vth+Vm) is imposed on the pixel 111, thereby making the pixel 111 emit light. Then, the P channel FET 21*a* of the scanning electrode driving circuit 2 connected to the first scanning electrode 201 is turned off, and the N channel FET 21*b* is turned on. Thus, electric charges stored in the pixels on the scanning electrode 201 are discharged.

Then, following the above step, the P channel FET 31*a* of the scanning electrode driving circuit 3 connected to the second scanning electrode 301 is turned on, bringing the voltage on the scanning electrode 301 to the voltage (Vth+Vm). At the same time, output FETs of the scanning electrode driving circuits 2, 3 connected to all other scanning electrodes are turned off, bringing those scanning electrodes to a floating state. By supplying respective voltages to data electrodes 401, 402, 403 . . . in the same manner as described above as to the first scanning electrode 201, the pixels to be lit on the second scanning electrode 301 emit light. The time chart in FIG. 3 shows a situation, where the P channel FET 41*a* of the data electrode driving circuit 4 is turned on, the N channel FET 41*b* is turned off, the voltage Vm is supplied to the data electrode 401, and the voltage Vth is imposed on the pixel 121, thus making the pixel 121 inactive (the pixel 121 does not emit light). Then, the P channel FET 31*a* of the scanning electrode driving circuit 3 connected to the second scanning electrode 301 is turned off, and the N channel FET 31*b* is turned on, thus discharging electric charges stored in pixels on the scanning electrode 301. Similarly, all the scanning electrodes are scanned up to the bottom of the EL panel 1.

Next, the driving process in the negative field will be described. In the negative field, the ground voltage is supplied from the power source circuit 5 to the common line L1 connected to source electrodes of P channel FETs of the scanning electrode driving circuits 2, 3, and the voltage −Vth is supplied to the common line L2 connected to source electrodes of N channel FETs of the scanning electrode driving circuits 2, 3. At this time, the standard voltage on the scanning electrodes 201, 301, 202, 302 . . . becomes the ground level due to the operation of the parasitic diodes 21*c*, 22*c* . . . of the FETs of the scanning electrode driving circuits 2, 3. The FETs 41*b*, 42*b*, 43*b* . . . of the data electrode driving circuit 4 are turned on, bringing the data electrode voltage to the ground level. At this stage, no pixel emits light because the voltage imposed on all the pixels is 0 volt.

The scanning process in the negative field is performed in the same manner as in the positive field. However, in the negative field, the voltage −Vth is supplied to the scanning electrode, pixels on which are to be activated, and the voltage Vm is supplied to the data electrodes corresponding to pixels to be lit while the data electrodes corresponding to pixels not to be lit are kept at the ground level. Therefore, when the voltage Vm is supplied to a data electrode and the voltage −Vth is supplied to a scanning electrode, the voltage −(Vth+Vm) is imposed on a corresponding pixel and that pixel emits light. When a data electrode is brought to the ground level while a scanning electrode is at the −Vth level, a corresponding pixel does not emit light, because only the voltage −Vth is imposed on that pixel.

One positive field and one negative field constitute one cycle process, and a positive and negative field is alternately repeated thereafter.

Figure 4:
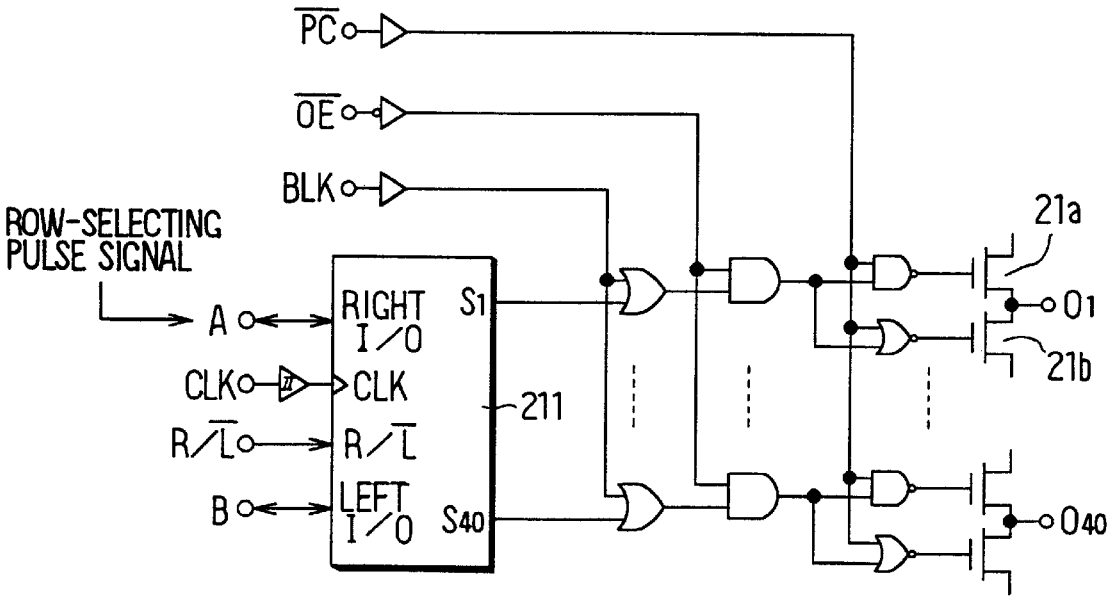
FIG. 4 is a diagram showing a scanning electrode driving circuit.

Referring to FIG. 4, the circuit structure of the scanning electrode driving circuits 2, 3 will be described. As the scanning electrode driving circuit, a scanning driver IC (integrated circuit) named μPD16302 which is sold in the market is used in the embodiment of the present invention. The scanning driver includes a shift register 211. The scanning driver IC sequentially delivers outputs from terminals $S_1$ to $S_{40}$ by shifting row-selecting pulse signals (its cyclic period corresponds to a vertical synchronizing signal) fed from a data input terminal A according to CLK signals, when its R/$\overline{L}$ terminal ($\overline{L}$ denotes a negative logic signal, and the same in the following description) is a high level (H). Though the scanning driver IC shown in FIG. 4 has forty terminals $S_1$–$S_{40}$, the number of terminals may be arbitrarily increased by connecting an output terminal B to a data input terminal A of another scanning driver IC. In the present embodiment, a blanking signal (BLK) and an $\overline{OE}$ signal which becomes an output-enabling signal are always kept at a low level (L). A $\overline{PC}$ signal is used as a signal to select either a P channel FET or an N channel FET. When a row-selecting pulse signal is fed to the sift register 211, it is sequentially shifted and delivers outputs.

Figure 5:
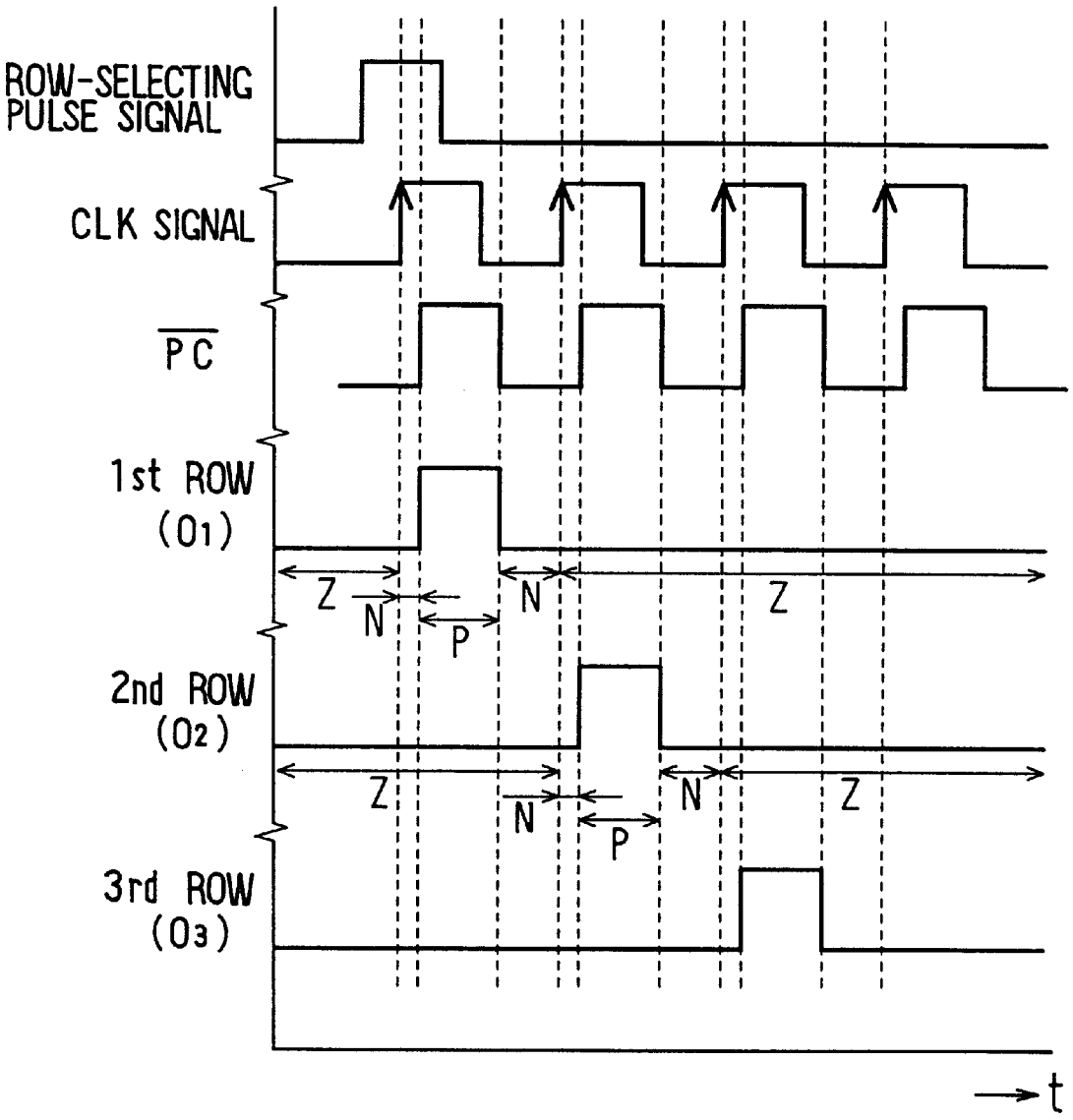
FIG. 5 is a time chart showing various signals and outputs of the scanning electrode driving circuit in a positive field.

FIG. 5 shows a time chart in the positive field. During a period in which the row-selecting signal is fed, an ON-period of the P channel FET and N channel FET are switched according to switching between H and L of the $\overline{PC}$ signal, and corresponding outputs are delivered from terminals $O_1$–$O_{40}$. In the graphs of FIG. 5, a letter Z denotes a period of a high impedance, a letter P a period in which the P channel FET is ON and the pixel is charged, and a letter N a period in which the N channel FET is OFF and the pixel is discharged. In the negative field, the levels, H and L of the $\overline{PC}$ signal are reversed from those in the positive field. Thus, the P channel FETs 21*a*, 31*a*, 22*a*, 32*a* . . . and the N channel FETs 21*b*, 31*b*, 22*b*, 32*b* . . . are turned on or off as shown in the time chart in FIG. 3, in the positive and negative fields. Scanning voltages are sequentially supplied to scanning electrodes 201, 301, 202, 302 . . .

Figure 6:
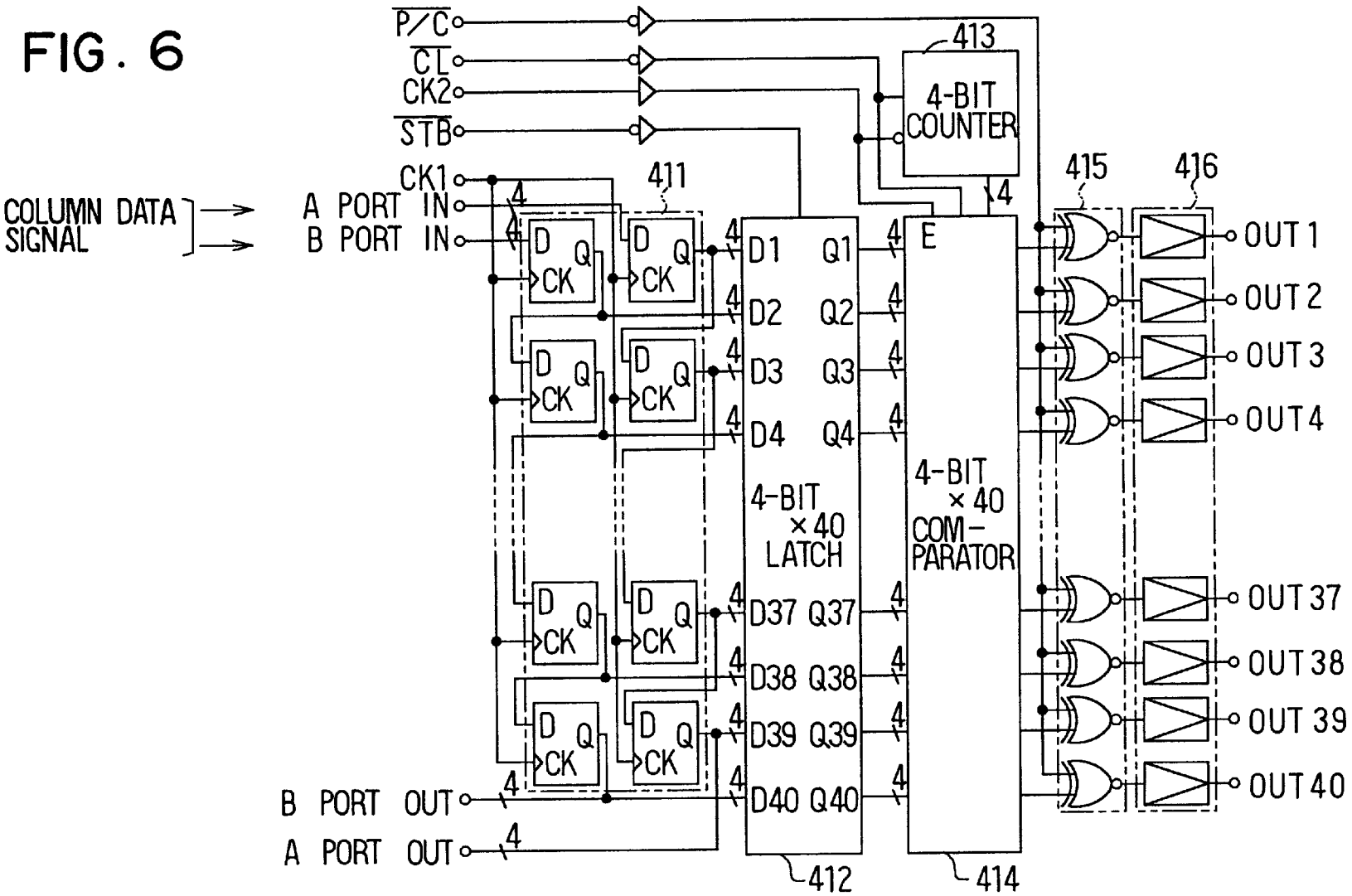
FIG. 6 is a diagram showing a data electrode driving circuit.

Referring to FIG. 6, the logic circuit 40 in the data electrode driving circuit 4 will be described. As the data electrode driving circuit 4, a data driver IC named TD62C948 made by Toshiba and sold in the market is used in the present embodiment. The data driver IC is composed of a shift register 411, a latch circuit 412, a counter (4-bit) 413, a comparator (4-bit×40) 414, an exclusive logical sum circuit 415, and an output circuit 416. The output circuit 416 is constituted by the P channel FETs 41*a*, 42*a* . . . . and the N channel EFTs 41*b*, 42*b* . . . shown in FIG. 1. 4-bit column data signals (brightness-step data) are fed to the shift register 411 from an A-PORT-IN and a B-PORT-IN. Then, the column data signals are transferred to the next sift register as shown in FIG. 6 in synchronism with the rising of a dot clock signal (CK1). After all the column data signals are transferred to the shift register 411, and when an $\overline{STB}$ signal which constitutes a horizontal synchronization signal becomes a low (L) level, outputs from the shift register 411 are latched in the latch circuit 412 and kept therein during a period in which the $\overline{STB}$ signal is a low level. Then, when $\overline{CL}$ signal turns form the L level to the H level, the counter 413, which determines a pulse width of voltage to be imposed on pixels, and comparator 414 become operative. At this time, the comparator 414 outputs H level signals except when the column data signal is 0 volt (data corresponding to no display). The counter 413 counts up according to the clock signal CK2, and the comparator 414 compares the count of the counter 413 with outputs $Q_1$–$Q_{40}$ latched in the latch circuit 412 and turns its output from the H level to the L level when both coincide. The outputs from the comparator 414 are fed to the exclusive logical sum circuit 415. In the negative field where a $\overline{P/C}$ signal is L, the outputs from the comparator 414 are fed to the output circuit 416 without being changed, and the voltage Vm is applied to the data electrodes. In the positive field where the $\overline{P/C}$ signal is H, the outputs from the comparator 414 are reversed and fed to the output circuit 416, and the ground voltage is supplied to the data electrodes. Thus, a voltage having a pulse width modulated according to the data signal is applied to each data electrode, and images are displayed with brightness steps. Though the data driver IC shown in FIG. 6 has forty outputs OUT-1 to OUT-40, the number of outputs may be arbitrarily increased by connecting the A-PORT-OUT and the B-PORT-OUT to an A-PORT-IN and a B-PORT-IN of another data driver IC.

Figure 7:
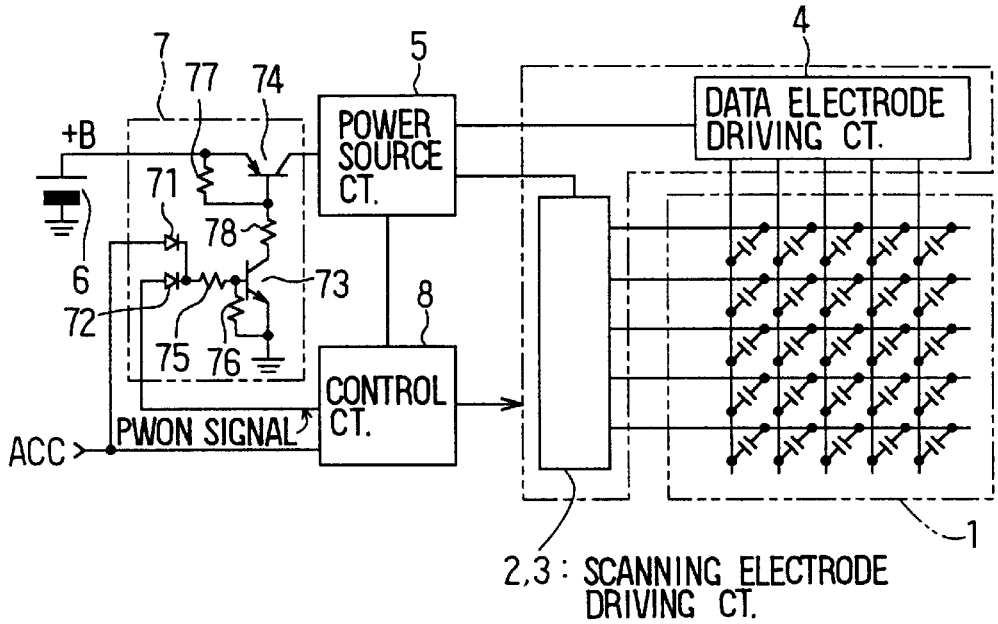
FIG. 7 is a circuit diagram showing an example of the EL display device used as an instrument panel for an automobile.

FIG. 7 shows an EL display device suitable for use in an instrument panel of an automobile. A battery voltage (+B) is supplied to the power source circuit 5 from a battery 6 mounted on the automobile through a switching circuit 7. From the power source circuit 5, the scanning voltage is supplied to the scanning electrode driving circuits 2, 3, the data voltage to the data electrode driving circuit 4, and further a voltage of 5 V to a control circuit 8. The control circuit 8 feeds various data for displaying images on the instrument panel to the scanning electrode driving circuit 2, 3 and the data electrode driving circuit 4. In other words, the control circuit 8 generates various data to be fed to the scanning driver IC and the data driver IC described above.

The switching circuit 7 includes diodes 71, 72, transistors 73, 74, and resistors 75, 76, 77, 78. When a key switch of the automobile is in an ACC position (an accessory position), and an ACC line is at a battery voltage level, the transistors 73, 74 of the switching circuit 7 turn on, and thereby the battery voltage is supplied to the power source circuit 5. The transistors 73, 74 are kept turned on and the battery voltage is supplied to the power source circuit 5 even after the key switch is turned off (the ACC line becomes 0 V) as long as a PWON signal is delivered from the control circuit 8. In other words, the diodes 71, 72 constitute a wired OR circuit, and the battery voltage is supplied to the power source circuit 5 either when the ACC line is at the battery voltage level or when the PWON signal is fed to the diode 72. The PWON signal is supplied from the control circuit 8 for a period necessary to scan the EL panel at least one time after the key switch is turned off.

Figure 8:
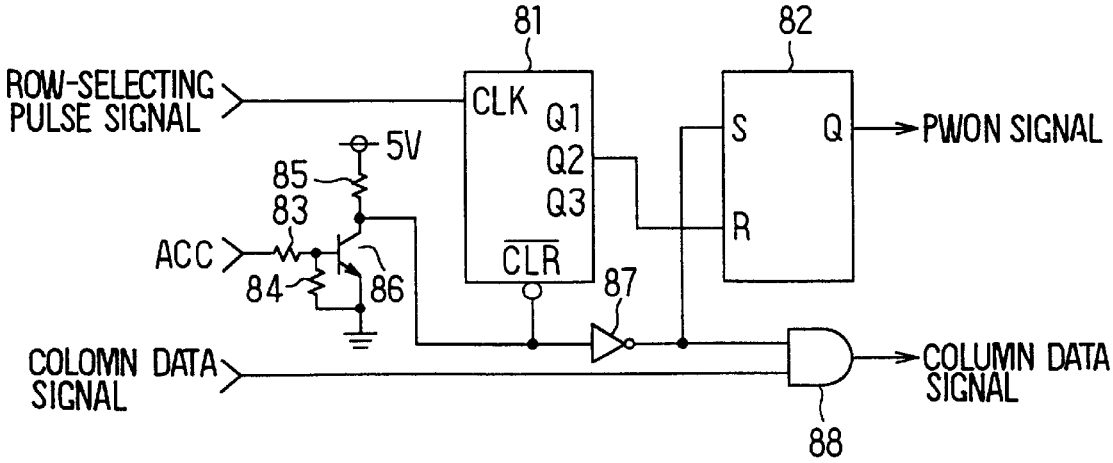
FIG. 8 is a diagram showing a control circuit used in the EL display device shown in FIG. 7.

FIG. 8 shows a circuit in the control circuit 8 for generating the PWON signal. The circuit includes a counter 81, a flip-flop circuit 82, resistors 83 to 85, a transistor 86, an inverter 87 and an AND gate 88. When the ACC line is at the battery voltage level, the transistor 86 is turned on and an output from the inverter 87 is a high level (H). Accordingly, the column data signal described above is delivered from the AND gate 88 without being changed. At this time, the counter 81 is cleared, the flip-flop 82 is set, and the PWON signal is at a high level (H). Under this situation, the EL panel normally displays images.

When the key switch is turned off, the ACC line becomes 0 V and the transistor 86 is turned off, thereby detecting that the key switch is turned off. At this time, the PWON signal from the flip-flop 82 is still kept at the high level (H), the output from the inverter 87 becomes the low level (L) due to turning off of the transistor 86, thereby making the column data signal from the AND gate 0 V. Scanning is continued because the scanning voltage is still supplied from the scanning electrode driving circuits 2, 3. Accordingly, the image displayed on the EL panel is eliminated. In other words, all the pixels on the panel are brought to a non-luminant state.

After the counter 81 counts two times the row-selecting pulse signal fed from the input terminal of the scanning driver IC, the counter 81 outputs a high level signal from its $Q_2$ terminal which in turn resets the flip-flop 82, turning the PWON signal to the low level. When the PWON signal becomes the low level, the transistors 73, 74 in the switching circuit 7 turn off, and thereby no voltage is supplied to the power source circuit 5, and power supply to the EL display device is shut off. If the key switch is turned off in a middle of a frame, a whole image of the frame can be eliminated because the row-selecting pulse signal corresponds to a vertical synchronization signal.

Figure 9:
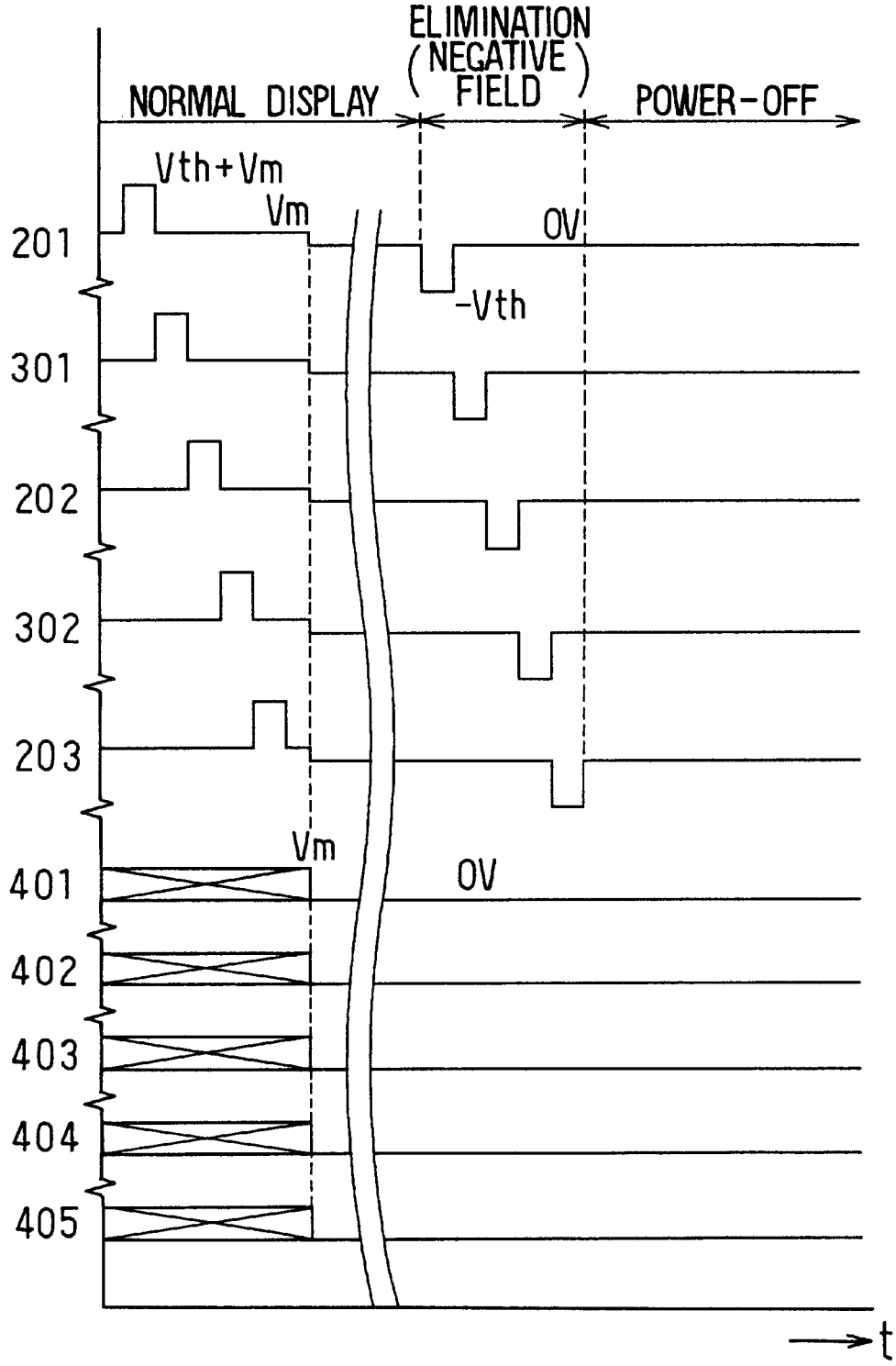
FIG. 9 is a time chart showing an image elimination process.

FIG. 9 shows a time chart of an image elimination process in the negative field when the key switch is turned off. When the key switch is turned off, the voltage −Vth is applied to the scanning electrodes, and 0 V to the data electrodes. In the image elimination process in the positive field, the voltage (Vth+Vm) is applied to the scanning electrodes, and the voltage Vm to the data electrodes.

Because the EL panel is scanned for a period covering at least one picture frame after the key switch is turned off, as described above, electric charges stored in all the pixels are discharged. Therefore, no residual image is displayed when the EL display device is turned on again. Though the control circuit 8 described above includes a circuit for generating image signals for the instrument, such circuit may be separated and built in a separate ECU for the instrument panel. The circuit for generating the PWON signal may be built in an ECU for controlling signals to be displayed on an instrument panel, and the PWON signal generating function may also be carried out by a soft ware instead of a hard ware.

Figure 10:
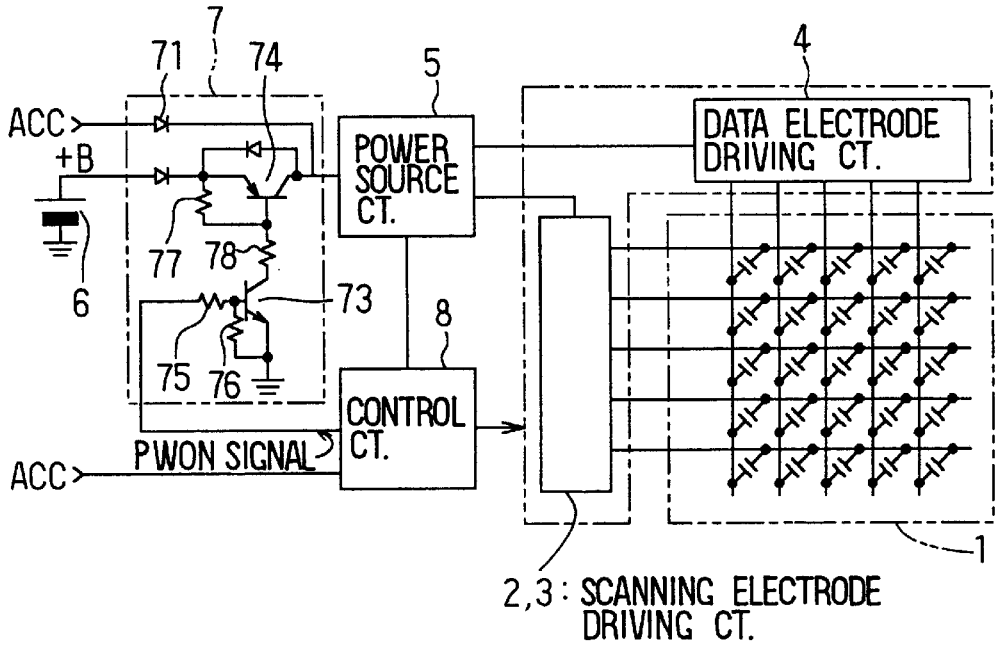
FIG. 10 is a circuit diagram showing another example of the EL display device used as an instrument panel for an automobile.
Figure 11:
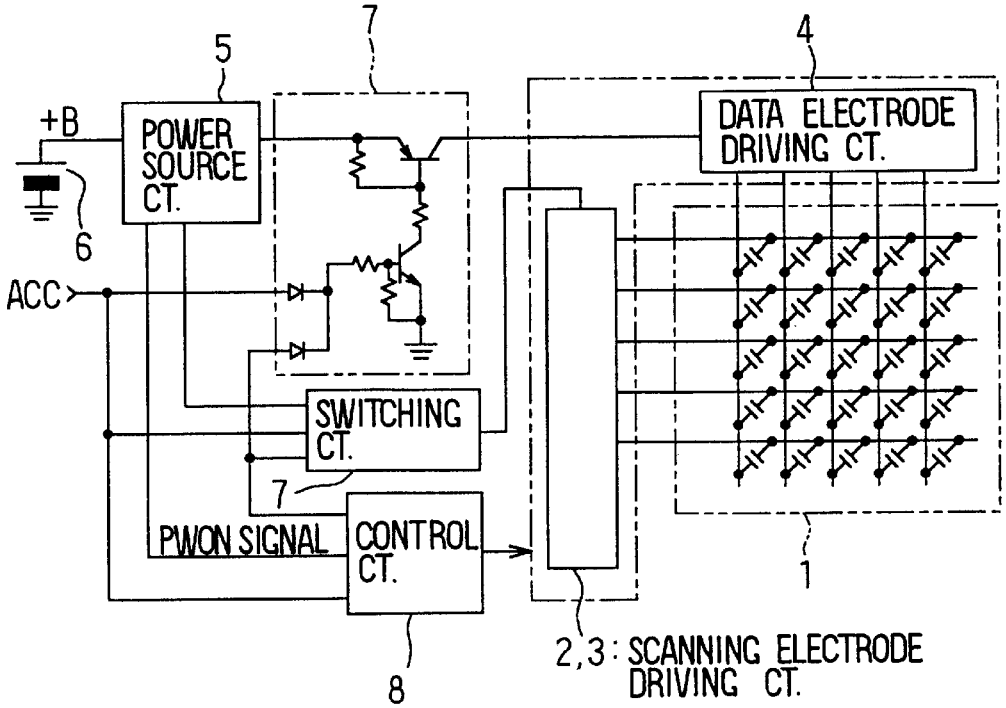
FIG. 11 is a circuit diagram showing a further example of the EL display device used as an instrument panel for an automobile.

The switching circuit 7 shown in FIG. 7 may be modified in a form shown in FIG. 10. In this modification, the voltage to the power source circuit 5 is supplied directly from the ACC terminal without passing through the transistor 74 in a normal display period. Accordingly, a voltage drop in the transistor 74 can be eliminated, and, accordingly, the modified form is more advantageous in this respect, compared with an usual wired OR circuit. Further, the switching circuit 7 may be modified in a form shown in FIG. 11, in which it is connected to the output side of the power source circuit 5. In this arrangement, however, it is necessary to use two switching circuits 7 having the same structure: one between the power source circuit 5 and the scanning electrode driving circuits 2, 3, and the other between the power source circuit 5 and the data electrode driving circuit 4, as shown in FIG. 11.

Figure 12:
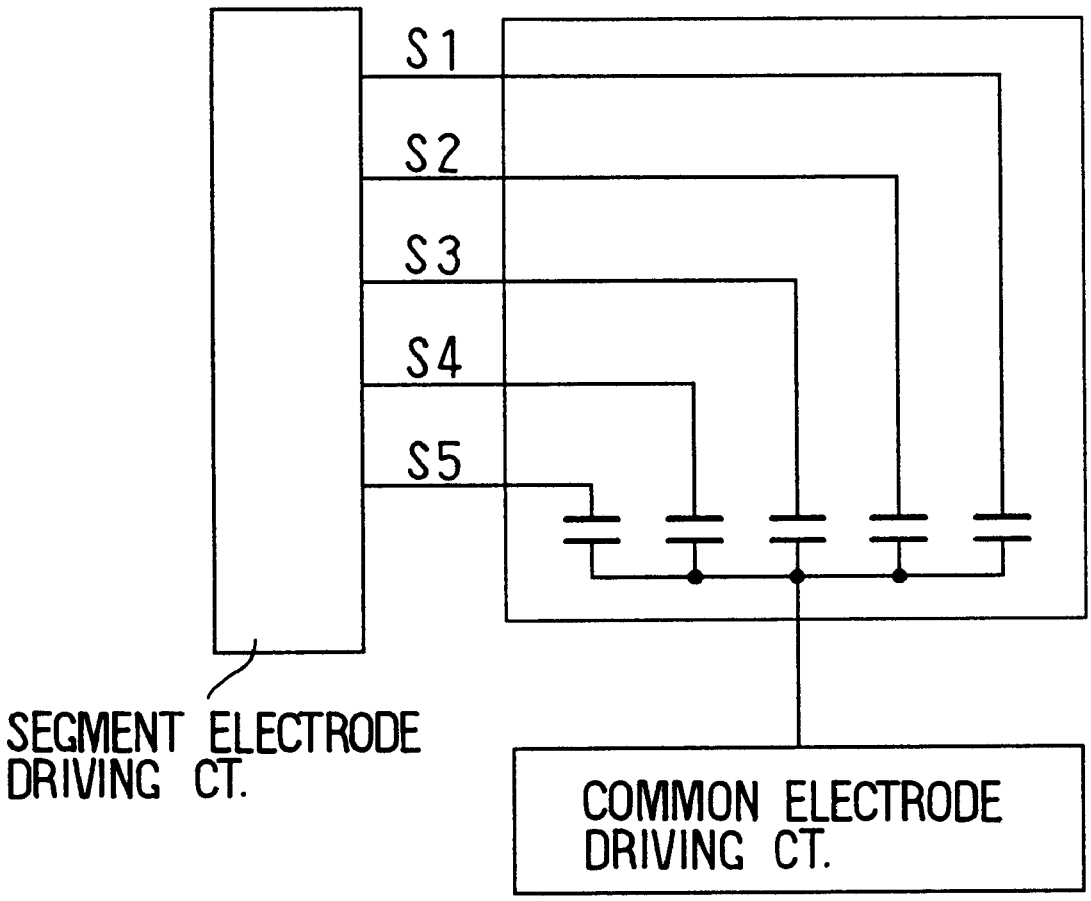
FIG. 12 is a schematic diagram showing an EL display device having a segment-display structure.
Figure 13:
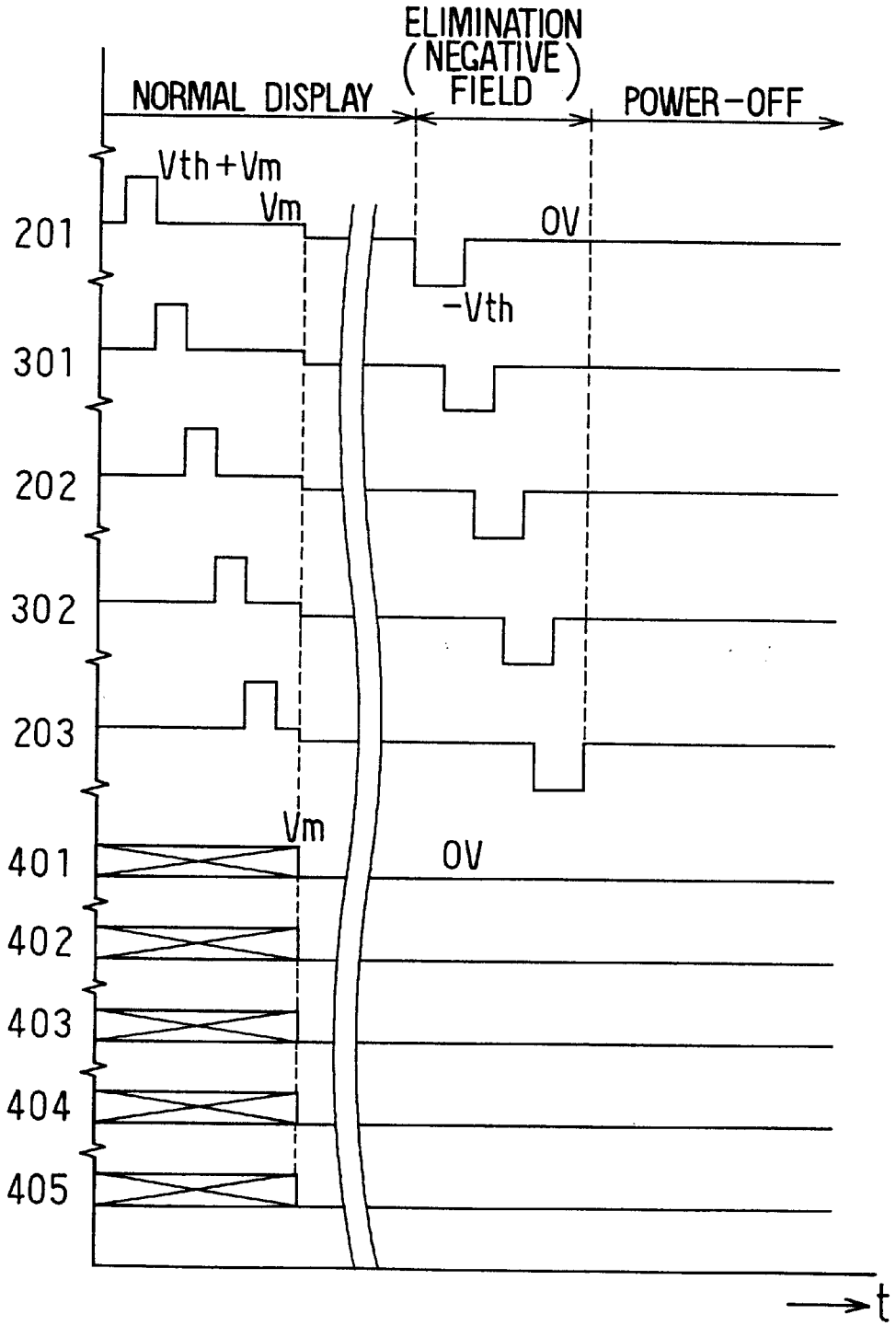
FIG. 13 is a time chart showing an image elimination process, slightly modified from the process shown in FIG. 9.

The present invention may be applied to an EL display panel for a personal computer. In this application, too, the EL panel is scanned for a certain period of time after the personal computer is turned off, so that electric charges stored in the pixels are discharged and residual images do not appear on the panel when the personal computer is turned on next time. Further, this invention may be applied to a segment-display type EL panel. One example of this application is shown in FIG. 12. Each segment in the panel is shown as a capacitor connected to segment electrode driving circuit and to a common electrode driving circuit. To eliminate electric charges stored in the segment after the panel is turned off, the common electrode is brought to the ground voltage, and the voltage Vth is imposed on all the segments.

Figure 14:
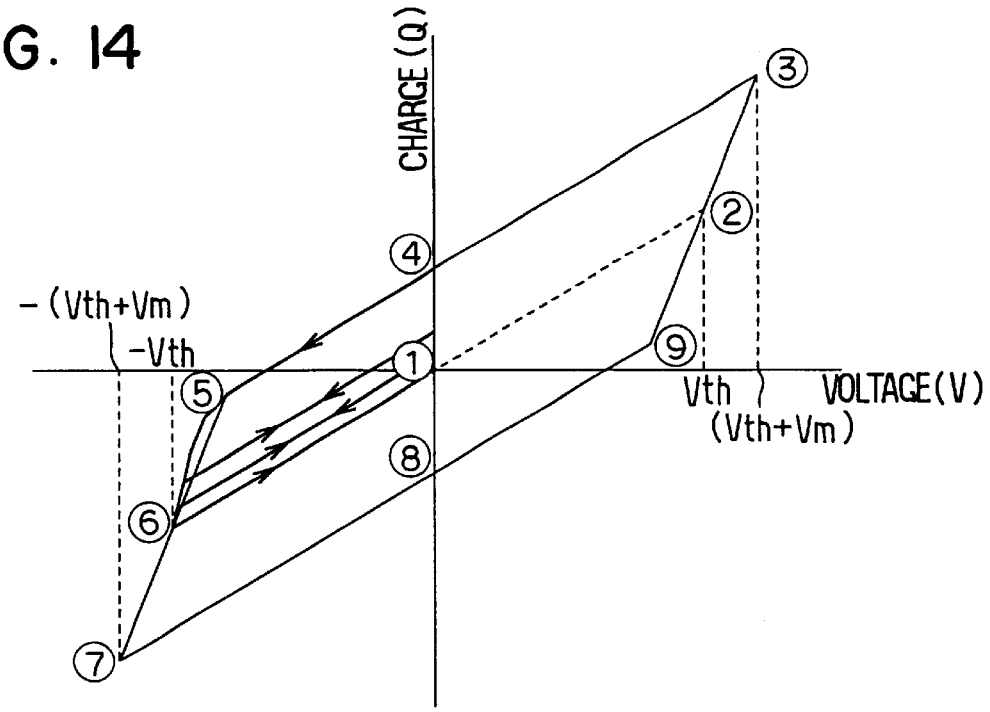
FIG. 14 is a graph showing an amount of polarized electric charge in a pixel relative to voltage imposed thereon, in case a plurality of pulses are imposed in an image elimination period.
Figure 15:
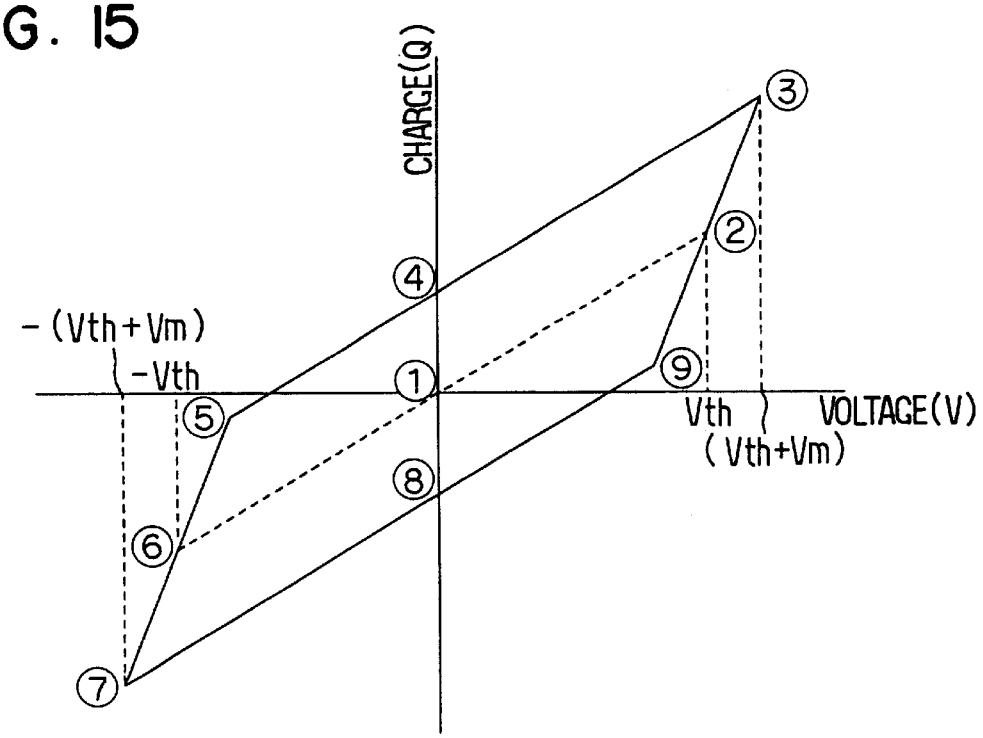
FIG. 15 is a graph showing an amount of polarized electric charge in a pixel relative to voltage imposed thereon.

The pulse width of the voltage imposed in the eliminating process may be made wider than the pulse width of the voltage imposed in the normal display period. One example is shown in a time chart of FIG. 13, in which scanning voltages applied during the normal display period and the elimination process in the negative field are shown. As shown in the time chart, the pulse width of −Vth is wider than that of (Vth+Vm). The wider pulse precipitates elimination of polarized electric charges stored in the pixels. It is also possible to apply a plurality of pulses in the elimination process, as shown in a Q-V characteristic in FIG. 14. In this case, the stored electric charges can be sufficiently discharged even if an amount of discharge performed by each pulse is small. Though the threshold voltage Vth (or −Vth) is imposed on all the pixels for eliminating the residual images in the embodiment described above, it is also possible to impose the voltage only on those pixels which have been activated in the normal display period. Further, the level of the voltage Vth for eliminating the residual images may be slightly varied. If the voltage is in a vicinity of Vth, the electric charges stored in the pixels can be sufficiently eliminated.

(Second Embodiment)

Figure 16:
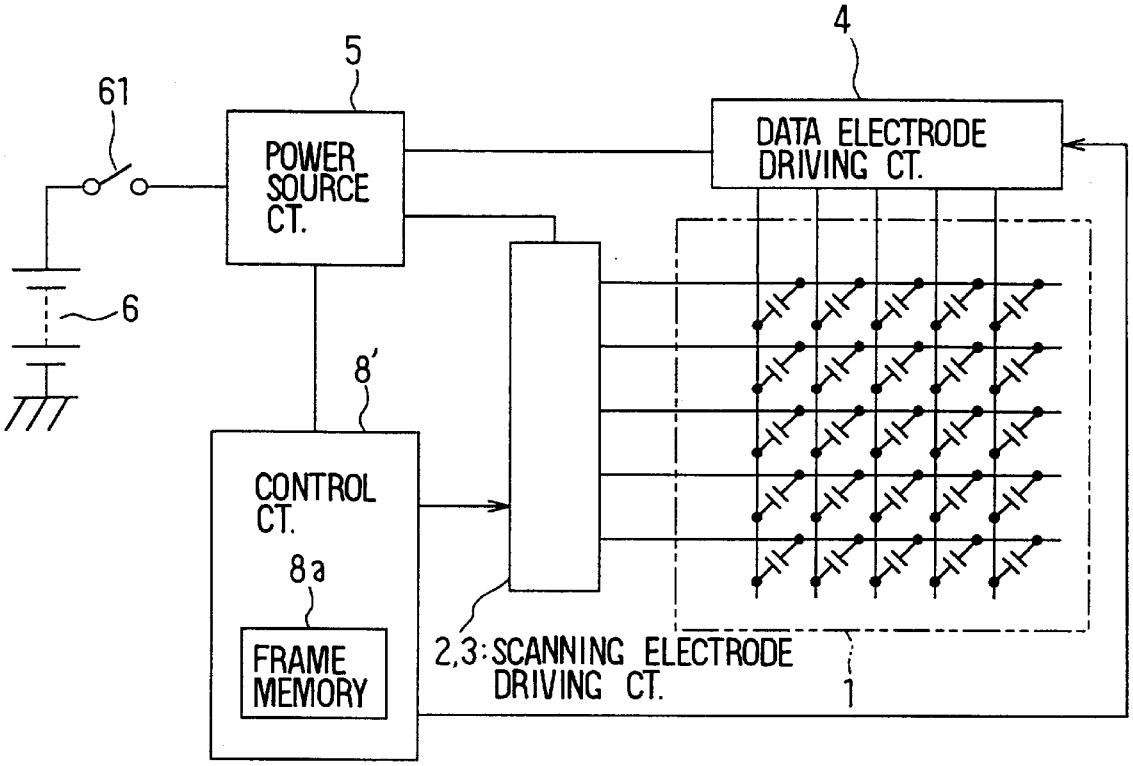
FIG. 16 is a circuit diagram showing a whole structure of an EL display device as a second embodiment of the present invention.

Referring to FIGS. 16 to 19, a second embodiment of the present invention will be described. In the second embodiment, the residual picture images are eliminated when the EL display panel is turned on next time, as opposed to the first embodiment in which the residual picture images are eliminated when the EL display panel is turned off. FIG. 16 shows a whole structure of the second embodiment and corresponds to FIG. 7 of the first embodiment. The EL panel 1 is driven by the scanning electrode driving circuits 2, 3 and the data electrode driving circuit 4 in the same manner as in the first embodiment. Electric power is supplied from the power source circuit 5 to both driving circuits. Both driving circuits are controlled by a control circuit 8' which includes a frame memory 8*a*. The battery 6 supplies power to the power source circuit 5 through a key switch 61.

Figure 17:
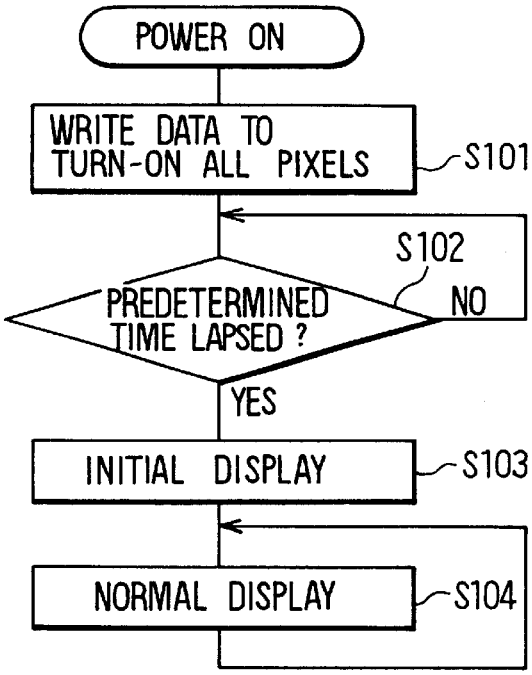
FIG. 17 is a flowchart showing a process performed by a control circuit used in the EL display device shown in FIG. 16.
Figure 18A:
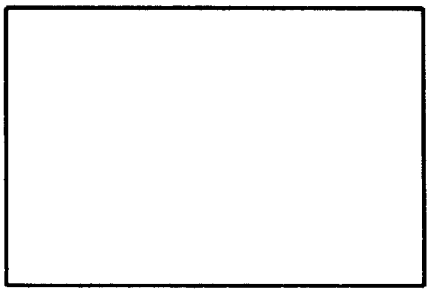
Figure 18B:
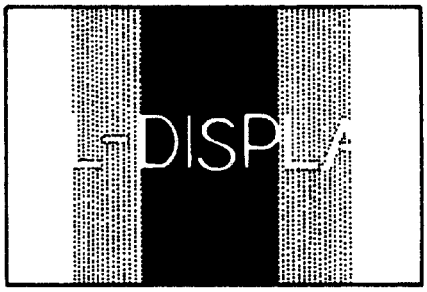
Figure 18C:
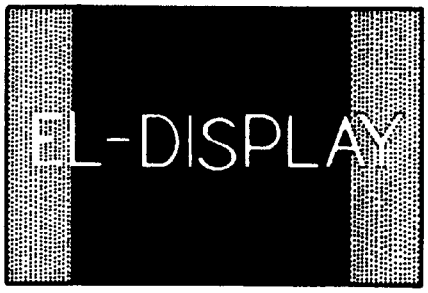
Figure 18D:
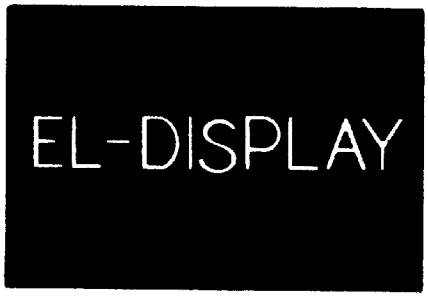

When the key switch 61 is turned on and the battery voltage is supplied to the power source circuit 5, the power source circuit 5 supplies the scanning voltages to the scanning electrode driving circuit 2, 3, the data voltages to the data electrode driving circuit 4, and an operation voltage of 5 V to the control circuit 8'. At this time, the control circuit 8' begins to perform a process according to a time chart shown in FIG. 17. At step S101, data to activate all the pixels on the panel (to let all the pixels emit light) are written on the frame memory 8*a*. At step S102, it is judged whether a predetermined time (for example, 500 m sec which is required to bring the power source circuit 5 to a state to supply sufficient voltages) has lapsed. After the predetermined time has lapsed, an initial image display process is performed at step S103. At the beginning of this step, all the pixels are lit according to the data written on the frame memory 8*a*. As a result, a whole area of the EL display panel becomes bright as shown in FIG. 18A. Then, the images on the panel change from FIG. 18A to FIG. 18D through FIG. 18B and FIG. 18C. In other words, the EL panel is all bright at first, and then a dark (or a certain color) portion in the center gradually spreads to both sides until it covers a whole area. Letters "EL-DISPLAY" are shown on the dark portion. The data to display the such images are sequentially written on the frame memory 8*a*. After the initial image display process is completed, the normal display is performed at step S104.

Since all the pixels on the EL panel are lit when the device is turned on, images due to the electric charges stored in the pixels become invisible. Though all the pixels are lit at the beginning in the foregoing embodiment, only a part of pixels may be lit, as long as the residual images become invisible. For example, if there are some pixels which are not lit in the normal display, it is not necessary to light those pixels at the beginning of the initial image display process.

Figure 19A:
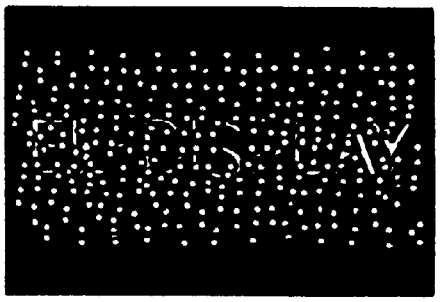
Figure 19B:
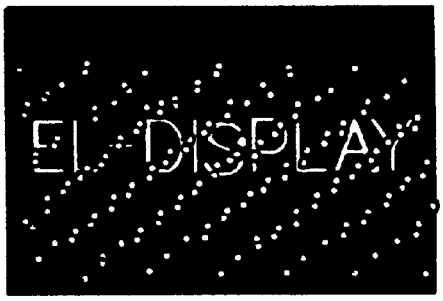
Figure 19C:
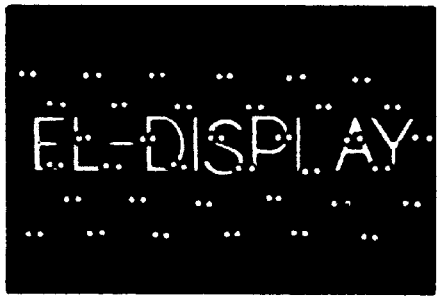
Figure 19D:
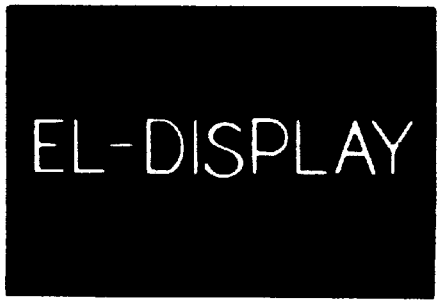

The initial images may be variably modified. For example, they may be ones shown in FIGS. 19A to 19D. Bright dots are scattered at random in a dark (or colored) background at first (FIG. 19A), and then the number of the bright dots gradually decreases. Finally, the bright dots disappear, and letters "EL-DISPLAY" are shown in the dark background (FIG. 19D). If all the pixels are lit at least one time in the course of the initial image display process, the residual images due to electric charges stored in the pixels become invisible. Preferably, positions of bright dots scattered at random are changed in a short period of time after the first image is displayed.

The residual images due to electric charges stored in the pixels can be made invisible to a certain degree only by delaying the normal display after the key switch is turned on without displaying the initial images. That is, if step S103 in the time chart of FIG. 17 is eliminated, the objective to eliminate the residual images from the first display is achieved to a certain extent. This is because the pixels storing electric charges therein are lit at a lower voltage, while other pixels are lit only after the voltage reaches the threshold voltage. If the normal display is started when the voltage supplied from the power source circuit 5 is not sufficiently high, the residual images are displayed at the beginning. If the normal display is started after the voltage becomes sufficiently high, the residual images are invisible because the normal images are also displayed together with the residual images.

The present invention realized in the second embodiment may also be applied to a personal computer having an EL display panel and to a segment-display type EL panel.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electroluminescent display device comprising:

an electroluminescent panel having electroluminescent elements and being powered by a DC power source;

driver means for selectively activating the electroluminescent elements to emit light therefrom;

a power source circuit for supplying electric power to the driver means;

switching means connected between the DC power source and the power source circuit; and a controller for controlling operation of the driver means and the switching means, wherein:

the driver means continues to apply after termination of a display operation, for at least one period of the electroluminescent panel, a voltage having a value in a vicinity of a threshold voltage used to activate the electroluminescent elements on at least all of the electroluminescent elements which were activated in a previous display operation, whereby the applied voltage eliminates residual charges stored in the electroluminescent elements in the previous display operation, which cause a momentary image display upon re-starting the display operation; and wherein the switching means shuts off power from the DC power source to the power source circuit after the application of the voltage to eliminate residual charge.

2. An electroluminescent display device mounted on a vehicle and powered by an on-board battery comprising:

an electroluminescent panel having electroluminescent elements;

driver means for selectively activating the electroluminescent elements to emit light therefrom;

a power source circuit for supplying electric power to the driver means;

switching means for controlling power supply from the battery to power source circuit, operation of the switching means being triggered by a key switch of the vehicle; and a controller for controlling operation of the driver means and the switching means, wherein:

the driver means continues to apply termination of a display operation, for at least one period of the electroluminescent panel, a voltage having a value in a vicinity of a threshold voltage used to activate the electroluminescent elements on at least all of the electroluminescent elements which were activated in a previous display operation, whereby the applied voltage eliminates residual charges stored in the electroluminescent elements in the previous display operation, which cause a momentary image display upon re-starting the display operation; and wherein the switching means shuts off the power supply from the battery to the power source circuit after the application of the voltage to eliminate residual charge.

3. The electroluminescent display device as in claim 2, wherein:

the controller generates a signal indicating the driver means to continue to apply the voltage upon turning off the key switch; and the switching means allows power from the battery to the power source circuit either when the key switch is kept turned on or when the indicating signal exists.

4. The electroluminescent display device as in claim 3, wherein:

the switching means includes switching elements;

the battery supplies power to the power source circuit through the switching elements when the indicating signal exists; and a signal indicating that the key switch is kept turned on is fed to the switching means.

5. The electroluminescent display device as in claim 1, wherein:

the voltage having a value in the vicinity of the threshold voltage applied after termination of the display operation is a pulse voltage having a width which is wider than that of a pulse voltage applied to activate the electroluminescent elements.

6. An electroluminescent display device powered by a DC power source comprising:

an electroluminescent panel including a plurality of scanning electrodes, a plurality of data electrodes, and an electroluminescent layer interposed between the scanning and data electrodes, the scanning and data electrodes constituting a matrix, each intersection of the scanning and data electrodes and the electroluminescent layer constituting a plurality of pixels;

a scanning electrode driving circuit for sequentially applying scanning voltages on the scanning electrodes, polarities of the scanning voltages being alternately switched every positive and negative field;

a data electrode driving circuit for applying data voltages on the data electrodes;

a power source circuit for supplying voltages to the scanning and data electrode driving circuits;

a switching circuit for allowing and shutting off power from the DC power source to the power source circuit; and a control circuit for controlling the scanning electrode driving circuit to apply a voltage to eliminate residual charges and has a value in a vicinity of a threshold voltage used to activate the pixels on the scanning electrodes for a period at least covering one field after a termination of display on the panel, the control circuit controlling the data electrode driving circuit to apply a data voltage which inactivates the pixels so that the pixels do not emit light on the data electrodes for the same period in which the scanning voltage is applied on the scanning electrodes after termination of display on the panel, and for controlling the switching circuit to shut off the voltage supply from the DC power source to the power source circuit.

7. The electroluminescent display device as in claim 6, wherein:

the voltage having the value in the vicinity of the threshold voltage and applied on the scanning electrodes for the period at least covering one field is the same voltage as the scanning voltage applied for a normal display.

8. An electroluminescent display device comprising:

an electroluminescent panel having electroluminescent elements;

driver means for selectively activate the electroluminescent elements to emit light therefrom;

power source means for supplying electric power to the driver means; and a controller for controlling operation of the driver means and the power source means, wherein:

substantially all the electroluminescent elements are activated to emit light causing an image due to residual charges to be invisible, and displaying an initial display on the panel, upon turning on the electroluminescent display device.

9. The electroluminescent display device as in claim 8, wherein:

the electroluminescent elements constitute pixels which display images on the panel; and the controller causes substantially all the pixels to emit light upon turning on the electroluminescent display device.

10. The electroluminescent display device as in claim 8, wherein:

the electroluminescent elements constitute pixels which display images on the panel; and the controller causes the pixels scattered at random on the panel to emit light upon turning on the electroluminescent display device.

11. The electroluminescent display device as in claim 8, wherein:

the electroluminescent panel starts to display the initial display when the power source circuit establishes a predetermined voltage level after the power source is turned on.

12. A method of driving an electroluminescent display panel having picture elements, the method comprising steps of:

displaying images on the electroluminescent panel by applying to the picture elements scanning voltages and data voltages in synchronized relation;

discontinuing image display by changing the data voltages to a voltage level which displays no image while continuing to supply the scanning voltages for a period sufficient to scan all the picture elements at least one time, thereby eliminating electric charges stored in the picture elements, which cause a momentary image upon re-starting the image display; and shutting off power for driving the electroluminescent display panel.

13. A method of driving an electroluminescent display panel having picture elements, the method comprising steps of:

starting a power supply for driving the electroluminescent display panel;

activating substantially all the picture elements so that the picture elements emit light at least one time, thereby making residual images invisible, which are momentarily displayed upon starting the power supply; and displaying images on the electroluminescent display panel by imposing scanning voltages and data voltages on the picture elements.

14. The electroluminescent display device as in claim 9, wherein:

the electroluminescent panel starts to display the initial display when the power source circuit establishes a predetermined voltage level after the power source circuit is turned on.

15. The electroluminescent display device as in claim 10, wherein:

the electroluminescent panel starts to display the initial display when the power source circuit establishes a predetermined voltage level after the power source circuit is turned on.

16. The electroluminescent display device as in claim 1, wherein the momentary image display is a combination of an image due to the residual charges and an image appearing upon re-starting the display operation.

* * * * *